US007744259B2

(12) United States Patent
Walczak et al.

(10) Patent No.: US 7,744,259 B2
(45) Date of Patent: Jun. 29, 2010

(54) DIRECTIONALLY-ADJUSTABLE LED SPOTLIGHT

(75) Inventors: Steven R. Walczak, Hales Corners, WI (US); Kurt Wilcox, Libertyville, IL (US); Wayne Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 11/541,906

(22) Filed: Sep. 30, 2006

(65) Prior Publication Data

US 2008/0080190 A1 Apr. 3, 2008

(51) Int. Cl.
*F21S 8/00* (2006.01)

(52) U.S. Cl. ..... 362/421; 362/373; 362/294; 362/471

(58) Field of Classification Search ..... 362/470–471, 362/294, 373, 800, 249–250, 418, 427, 443, 362/419, 421, 429, 430
See application file for complete search history.

(56) References Cited

U.S. PATENT DOCUMENTS

| | | | | |
|---|---|---|---|---|
| 3,912,918 | A * | 10/1975 | Feinbloom | 362/581 |
| D238,581 | S | 1/1976 | Lehmann | |
| 3,950,639 | A | 4/1976 | Van Steenhoven | |
| 4,298,912 | A * | 11/1981 | Dearth | 362/490 |
| 4,330,814 | A | 5/1982 | Baldwin et al. | |
| 4,750,096 | A | 6/1988 | Lim | |
| 4,872,097 | A | 10/1989 | Miller | |
| 5,434,765 | A | 7/1995 | Kelly et al. | |
| 5,486,989 | A | 1/1996 | Compton | |
| 5,672,004 | A * | 9/1997 | Schmidt, Jr. | 362/421 |
| D384,769 | S | 10/1997 | Holten | |
| 5,690,424 | A | 11/1997 | Warshauer et al. | |
| 6,029,939 | A | 2/2000 | Lin | |
| 6,367,949 | B1 | 4/2002 | Pederson | |
| 6,386,274 | B1 | 5/2002 | Wang et al. | |
| 6,390,653 | B1 * | 5/2002 | Schrewe | 362/374 |
| D464,938 | S | 10/2002 | Hegde | |
| D471,523 | S | 3/2003 | Hegde | |
| D471,881 | S | 3/2003 | Hegde | |
| 6,565,238 | B1 | 5/2003 | Pyrtle | |
| 6,720,566 | B2 | 4/2004 | Blandford | |
| 6,787,999 | B2 | 9/2004 | Stimac et al. | |
| 6,799,864 | B2 | 10/2004 | Bohler et al. | |
| 6,871,983 | B2 | 3/2005 | Jacob et al. | |
| 6,877,709 | B2 * | 4/2005 | March et al. | 248/549 |
| 6,880,956 | B2 | 4/2005 | Zhang | |
| 6,955,451 | B2 | 10/2005 | Coushaine et al. | |
| 6,964,501 | B2 | 11/2005 | Ryan | |
| D525,374 | S | 7/2006 | Maxik et al. | |
| D527,119 | S | 8/2006 | Maxik et al. | |

(Continued)

FOREIGN PATENT DOCUMENTS

| | | |
|---|---|---|
| EP | 1 521 031 | 4/2005 |

(Continued)

*Primary Examiner*—Jong-Suk (James) Lee
*Assistant Examiner*—Julie A Shallenberger
(74) *Attorney, Agent, or Firm*—Jansson Shupe & Munger Ltd.

(57) ABSTRACT

The inventive directionally-adjustable LED spotlight is comprised of a fixed heat sink and an LED-array-bearing structure. The LED-array-bearing structure is adjustably attached in a heat transfer relationship to the fixed heat sink.

10 Claims, 4 Drawing Sheets

U.S. PATENT DOCUMENTS

| | | | | |
|---|---|---|---|---|
| 7,097,332 | B2 | 8/2006 | Vamberi | |
| D528,673 | S | 9/2006 | Maxik et al. | |
| 2002/0093820 | A1 | 7/2002 | Pederson | |
| 2003/0210554 | A1 * | 11/2003 | Broelemann | 362/471 |
| 2003/0214803 | A1 * | 11/2003 | Ono et al. | 362/1 |
| 2004/0213016 | A1 | 10/2004 | Rice | |
| 2005/0073244 | A1 | 4/2005 | Chou et al. | |
| 2006/0098308 | A1 | 5/2006 | Angelini et al. | |

FOREIGN PATENT DOCUMENTS

| | | |
|---|---|---|
| JP | 2005/129354 | 5/2005 |
| JP | 2006-4863 | 1/2006 |
| JP | 2006-40872 | 2/2006 |
| JP | 2006-79991 | 3/2006 |
| WO | WO02/35356 | 1/2002 |
| WO | WO2004/079256 | 9/2004 |

* cited by examiner

DIRECTIONALLY-ADJUSTABLE LED SPOTLIGHT

FIELD OF THE INVENTION

This invention is related generally to light fixtures and, more particularly, to LED (Light Emitting Diodes) spotlights that include the capability of being directionally adjusted.

BACKGROUND OF THE INVENTION

In LED light fixtures, heat management is a highly important criteria since LEDs produce heat that is directed primarily in the direction opposite from the light emanation. Therefore, it is desirable to have a heat sink or other heat dissipation apparatus located behind the LED array. This need for a heat sink has led to the configuration of LED fixtures to include a heat sink in a fixed relationship to the LED array.

Furthermore, this fixed relationship between the heat sink and the LED array has caused difficulty in designing an adjustable spotlight type fixture while utilizing LEDs, because the combination of the heat sink with the LED array, leads to an elongated arrangement that is difficult to reposition and leads to tall fixtures when incorporating both the heat sink and the array into the fixture. In light fixtures intended for positioning at considerable height, this presents particularly great difficulties for effectively positioning and locking the spotlight into place.

While a vast array of LED light fixtures have been developed, a need exists for an improved LED spotlight fixture adapted for easy repositioning yet still having effective heat dissipation characteristics

OBJECTS OF THE INVENTION

It is an object of the invention to provide an LED spotlight fixture overcoming some of the problems and shortcomings of the prior art, including those referred to above.

Another object of the invention is to provide an LED spotlight fixture adapted for easy repositioning while still maintaining heat dissipation so that the fixture operates safely.

How these and other objects are accomplished will become apparent from the following descriptions and the drawings.

SUMMARY OF THE INVENTION

The present invention provides an LED spotlight fixture designed for easy repositioning of the light while maintaining proper heat dissipation. This invention, which will be described in detail below, is an improvement in LED light design where the LED array and the heat sink were in a fixed relationship with each other.

The inventive directionally-adjustable LED spotlight is comprised of a fixed heat sink and an LED-array-bearing structure. The LED-array-bearing structure is adjustably attached in a heat transfer relationship to the fixed heat sink.

In a preferred embodiment of the directionally-adjustable LED spotlight, the fixed heat sink is of a socket-shaped design and the LED-array-bearing structure is of a ball-shaped design corresponding to the socket-shape of the heat sink. The ball and socket design allows for maximum contact between the heat sink and the LED-array-bearing structure thus facilitating the maximum transfer of heat to the heat sink.

In a further preferred embodiment of the current invention, the directionally-adjustable LED spotlight further includes a retention assembly in the form of a collar that is releasably secured around an upper edge of the fixed heat sink. The retention assembly secures the LED-array-bearing structure in firm contact with the heat sink and can be loosened to move the LED-array-bearing structure to shift the focus of the spotlight.

In another preferred embodiment the LED-array-bearing structure includes a ball portion and an LED array attached to the ball portion and including a plurality of LEDs.

In yet another preferred embodiment of the current invention, the heat sink and the ball portion of the LED-array-bearing structure are made from a heat-conducting material such as metal and the heat sink includes a plurality of fins extending outwardly from the ball-shaped LED-array-bearing structure. This construction from a heat conducting material facilitates the transfer of heat from the LEDs to the heat sink and the fins provide increased surface area from which the heat can dissipate.

This invention is based in part on the discovery that sufficient heat transfer can occur by contacting partial spherical surfaces together to enable the LED array to safely function. This allows moving the heat sink further from the LED array and therefore allows for the introduction of an adjustable attachment between the LED array and the heat sink. As long a heat transfer relationship (a connection that allows efficient transfer of heat from one portion to the other) exits between the LED array and the heat sink, the addition of the adjustable attachment does not impede safe operation of the LEDs.

DETAILED DESCRIPTION OF THE PREFERRED EMBODIMENTS

Figure 1:
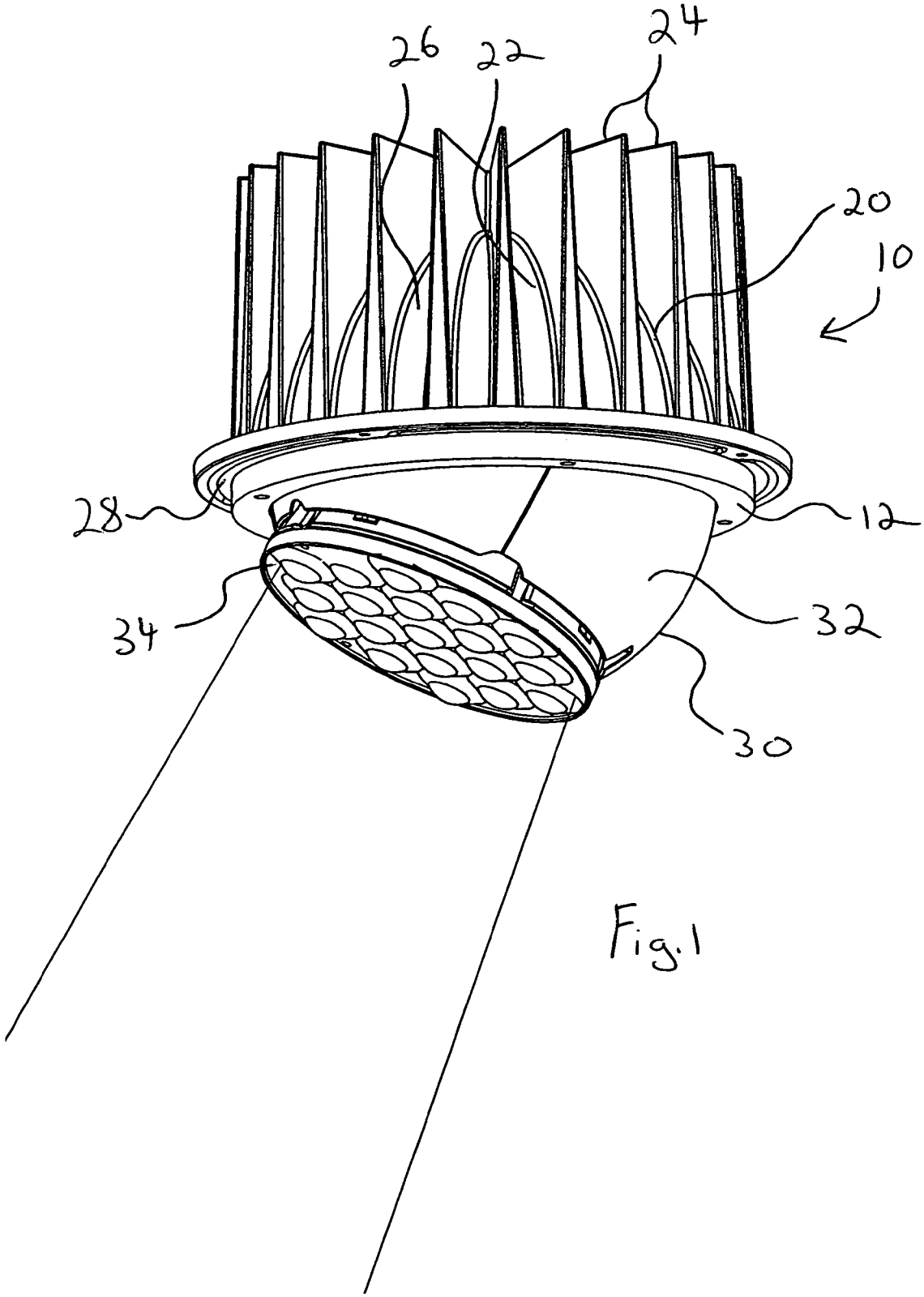
FIG. 1 is a perspective view of a preferred embodiment of a directionally-adjustable LED spotlight of the present invention oriented if the embodiment were mounted in a ceiling.
Figure 2:
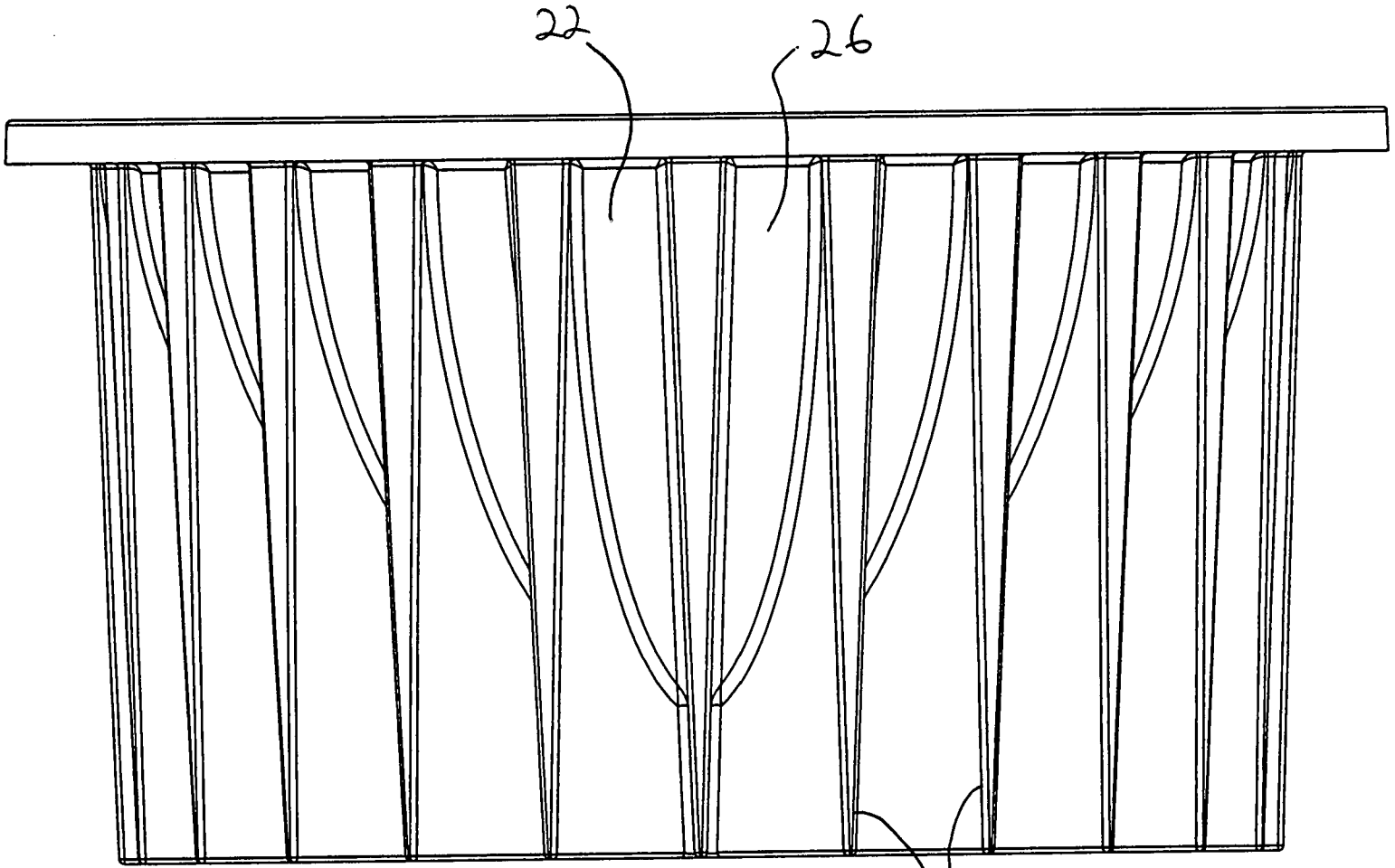
FIG. 2 is a side view of the fixed heat sink of the embodiment of FIG. 1.

FIG. 1 illustrates a preferred embodiment of a directionally-adjustable LED spotlight 10 of the current invention. The LED spotlight 10 includes a fixed heat sink 20 and an LED-array-bearing structure 30. As seen in FIG. 2, the heat sink 20 is in a socket shape shown in the socket portion 22 and further includes a plurality of fins 24 that extend outwardly from an outer surface 26 of the heat sink 20.

Figure 3B:
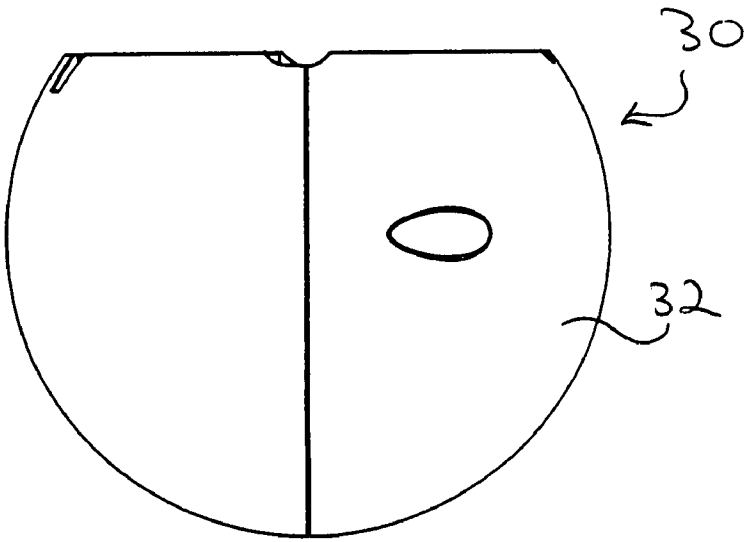
FIG. 3*b* is a side view of the ball portion of the LED-array bearing structure of FIG. 1.
Figure 3A:
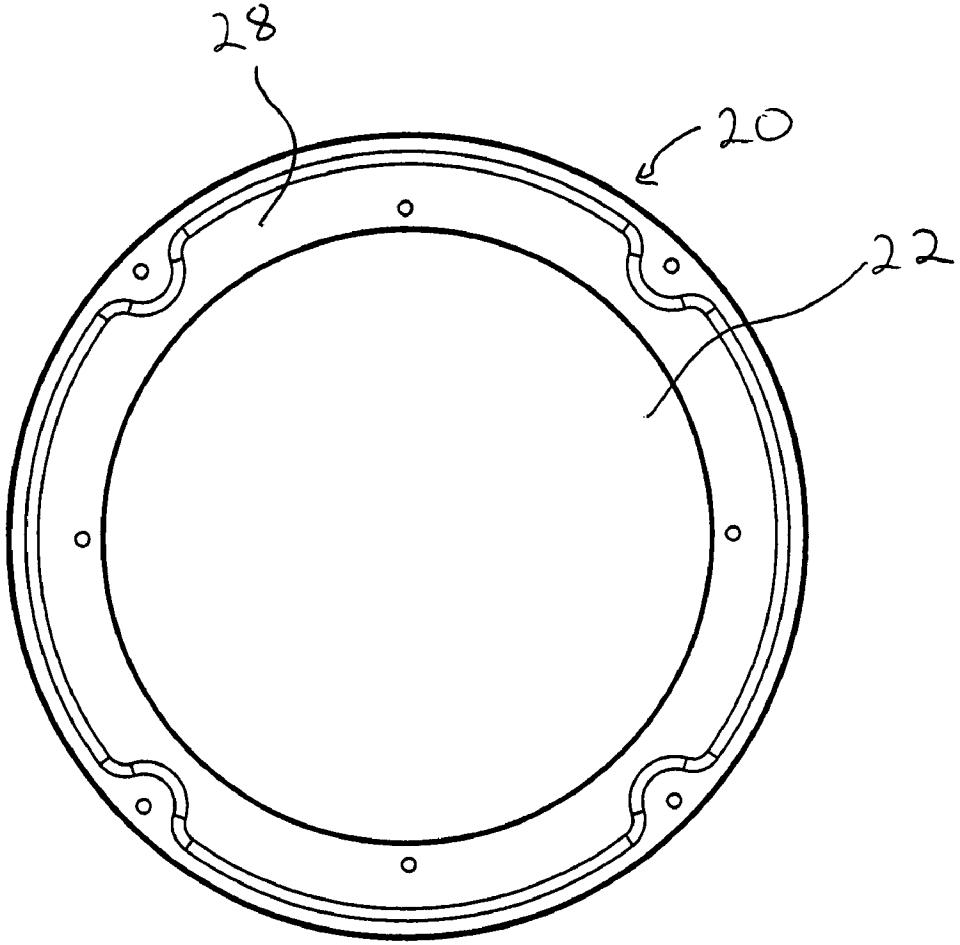
FIG. 3*a* is a top view of the fixed heat sink of FIG. 2.

Referring again to FIG. 1, the LED-array-bearing structure 30 includes a ball portion 32 and an LED array 34. As can be seen in FIGS. 3*a* and 3*b*, the ball portion 32 is sized to fit inside the socket portion 22 of the heat sink 20. Furthermore, the ball portion 32 is made of metal and is hollow. The ball and socket design of the heat sink 20 and the LED-array-bearing structure 30 allow for the entirety of the socket portion 22 of the heat sink 20 to be in contact with the ball portion 32 of the LED-array-bearing structure 30. This contact ensures a heat transfer relationship between the two parts.

Figure 4B:
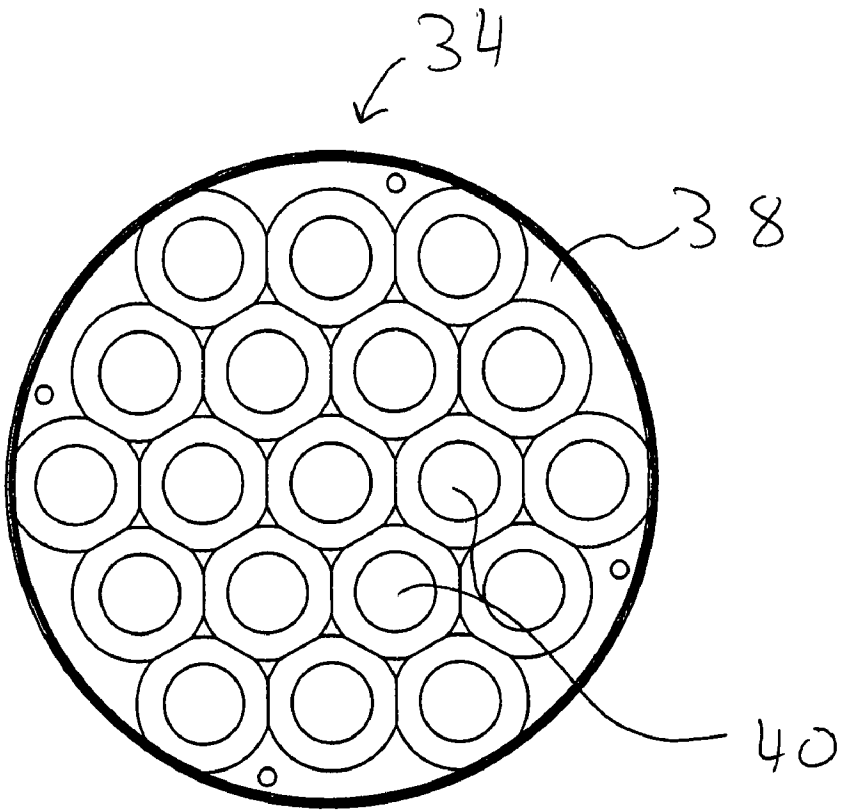
FIG. 4*b* is a top view of the LED array of the LED-array-bearing structure of the embodiment of FIG. 1.
Figure 4A:
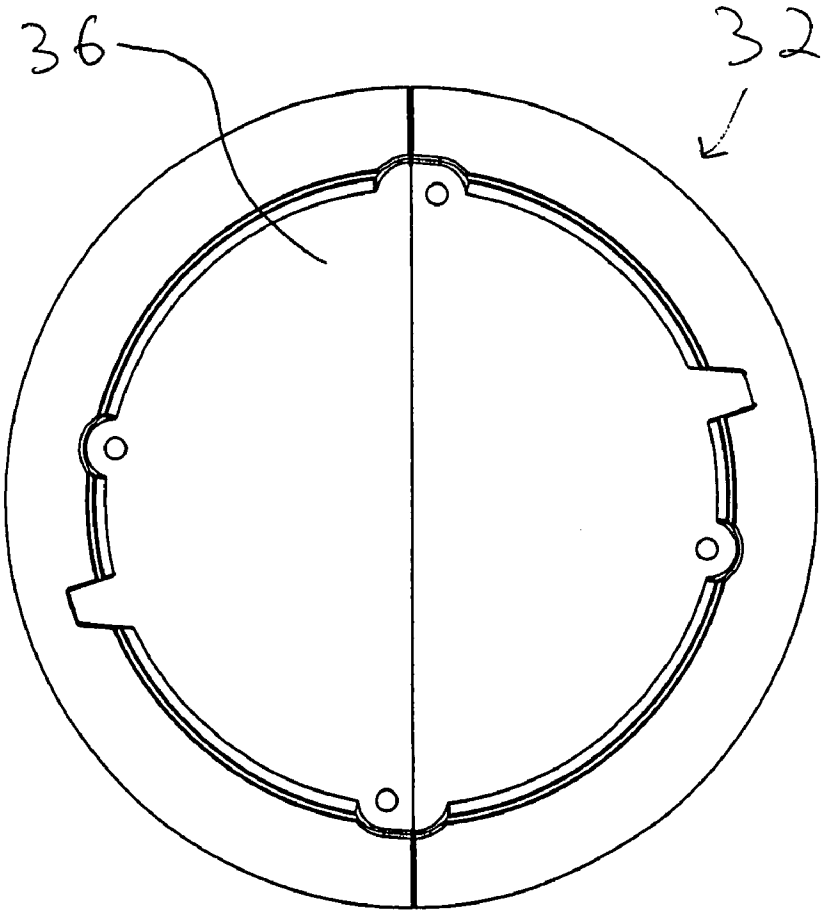
FIG. 4*a* is a top view of the ball portion of the LED-array-bearing structure of FIG. 3*b*.

As shown in FIG. 4*a* the ball portion 32 is not completely spherical, rather the ball portion 32 includes platform portion 36 that defines the top of the ball portion 32. FIG. 4*b* shows the LED array 34 that includes a first side 38 having a plurality of LEDs 40 and second side (not shown). As seen in FIGS. 4*a* and 4*b* the platform portion 36 is sized to receive the LED array 34 wherein the second side of the LED 34 array will come in contact with the platform portion 36. This sizing arrangement allows for efficient heat transfer from the LED array 34 to the ball portion 32 whereby heat can be transferred to the heat sink 20 and the fins 24.

Referring again to FIG. 1, the LED spotlight 10 further includes a collar 12 for securing the LED-array-bearing structure 30 in place. Once the LED-array-bearing structure 30 has been positioned in the heat sink 20 the collar 12 fits over the LED-array-bearing structure 30 and comes in contact with an upper edge 28 of the heat sink 20. The collar 12 is then secured using screws or other means and the LED-array-bearing structure 30 is then secured in place. In other embodiments, not shown the collar could be divided into sections rather than one piece. To readjust the LED-array-bearing structure 30 the collar 12 must simply be loosed and the LED-array-bearing structure 30 can be rotated to a different angle.

While the principles of the invention have been shown and described in connection with specific embodiments, it is to be understood that such embodiments are by way of example and are not limiting.

We claim:

1. A directionally-adjustable LED spotlight comprising a fixed heat sink with an arcuate interior surface, and a plurality of LEDs on a ball shaped LED array bearing structure with an arcuate exterior surface adjustably attached within the heat sink and in complementary direct heat transfer relationship therewith wherein the LED-array-bearing structure and heat sink are of a ball and socket design wherein the LED-array-bearing structure is the ball and the heat sink is the socket.

2. The directionally-adjustable LED spotlight of claim 1 wherein the ball-shaped LED-array-bearing structure is hollow.

3. The directionally-adjustable LED spotlight of claim 2 further comprising a retention assembly for releasably securing the ball-shaped LED-array-bearing structure in relation to the socket shaped heat sink.

4. The directionally-adjustable LED spotlight of claim 3 wherein the retention assembly comprises a collar releasably secured along an upper edge of the fixed heat sink.

5. The directionally-adjustable LED spotlight of claim 4 wherein the collar comprises multiple sections.

6. The directionally-adjustable LED spotlight of claim 1, wherein the LED array includes a first side with the LEDs and a second side, opposite the first side, and wherein the LED-array-bearing structure includes a platform portion corresponding in size to the second side of the LED array, the platform portion for receiving the LED array whereby the second side of the LED array is in contact with the platform portion.

7. The directionally-adjustable LED spotlight of claim 6 where the ball portion of the LED-array-bearing structure and the heat sink are made from a heat-conducting material.

8. The directionally-adjustable LED spotlight of claim 7, wherein the heat-conducting material is metal.

9. The directionally-adjustable LED spotlight of claim 8, wherein the heat sink includes a plurality of fins extending outwardly from a side of the heat sink opposite the ball-shaped LED-array-bearing structure.

10. A directionally-adjustable LED spotlight comprising a fixed heat sink with an arcuate interior surface, and a plurality of LEDs on a ball shaped LED array bearing structure with a solid arcuate exterior surface adjustably attached in complementary surface contact within the fixed heat sink wherein the LED-array-bearing structure and heat sink are of a ball and socket design wherein the LED-array-bearing structure is the ball and the heat sink is the socket.

* * * * *